United States Patent [19]

Goode

[11] 4,269,573

[45] May 26, 1981

[54] PUMP DRIVE MECHANISM FOR AN EVAPORATIVE COOLER

[75] Inventor: Chester L. Goode, Coalinga, Calif.

[73] Assignee: Milton Roy Company, St. Petersburg, Fla.

[21] Appl. No.: 61,993

[22] Filed: Jul. 30, 1979

[51] Int. Cl.[3] ..... F04B 13/10; F04B 35/00

[52] U.S. Cl. ..... 417/362; 74/209

[58] Field of Search ..... 417/319, 362; 74/206, 74/209; 415/126

[56] References Cited

U.S. PATENT DOCUMENTS

| | | | |
|---|---|---|---|
| 1,484,548 | 2/1924 | Bickerstaff | 74/209 |
| 2,730,905 | 1/1956 | Pence | 74/206 |
| 2,757,613 | 8/1956 | Dry | 417/362 |
| 2,798,660 | 7/1957 | Flynn | 417/362 |

*Primary Examiner*—William L. Freeh

*Attorney, Agent, or Firm*—Woodcock, Washburn, Kurtz, Mackiewicz & Norris

[57] ABSTRACT

A water pump drive mechanism for an evaporative cooler which includes a blower housing, a blower shaft extending therefrom, a pulley fixed on the shaft, and a water pump; the drive mechanism having an elongated tube mounted on the housing extending from the pump toward the pulley, a drive shaft extending longitudinally of the tube and rotationally mounted thereon having a lower end rotationally engaged with the pump and an upper end adjacent to the pulley, and a friction wheel mounted in the upper end of the drive shaft engaging the pulley for rotational drive of the water pump from the pulley.

11 Claims, 4 Drawing Figures

PUMP DRIVE MECHANISM FOR AN EVAPORATIVE COOLER

BACKGROUND OF THE INVENTION

1. Field of the Invention

The present invention relates to a water pump drive mechanism for use with an evaporative cooler, and more particularly to such a mechanism for installation in conventional evaporative coolers for driving water pumps employed therein from a blower pulley utilized therewith.

2. Description of the Prior Art

Evaporative coolers, in which air is cooled by evaporation of water into the air to provide comfort in hot weather, are well known. Such coolers are particularly effective in relatively dry climates. Such coolers conventionally include a box-like enclosure, the lower portion of which is supplied with water so as to maintain a predetermined level. Certain of the walls are provided with pads containing fibrous material which is moistened with water drawn from the lower portion of the enclosure. The water is delivered by a small pump through conduits to the top of the pads and runs downwardly thereof wetting the fibrous material with any excess returning to the lower portion of the enclosure. Such coolers frequently contain a power driven squirrel cage blower within the enclosure. The blower draws the relatively hot, dry ambient air through the pads where a portion of the water evaporates cooling the air and increasing its humidity. The cooled and humidified air is delivered from the blower through a duct extending therefrom to a location to be maintained at a comfortable temperature below that of the ambient air.

In such evaporative coolers, the water pump and the blower are rotationally driven by electric motors individual thereto. The blower has a shaft extending therefrom and provided with a pulley of relatively large diameter. The blower motor is customarily mounted upwardly of the blower with an output shaft extending parallel to the blower shaft. A relatively small pulley is mounted on the motor shaft in alignment with the larger pulley. An endless belt links the pulleys so that the blower is rotationally driven by the motor.

The water pump has a vertical drive shaft with a rotor secured to the lower end thereof below the level of the water. The pump has a casing enclosing the rotor and extending upwardly from the water in circumscribing relation to the vertical shaft. The casing and shaft extend upwardly from the water to the electric motor of the pump. The output shaft of the motor is an extension of the pump drive shaft and the motor is secured to the top of the casing so that the pump and motor form a single unit. The casing has feet extending concentrically therefrom which rest on the bottom of the enclosure. This water pump and motor unit is not connected to the balance of the evaporative cooler except for flexible electricity and water connections. The pump has only to raise the limited amount of water required to wet the pads to the top thereof, a few feet at the most.

As can be realized from the preceding description, the water pump motor is located in an extremely disadvantageous location for electrical equipment. At best, this motor constantly is exposed to the humid atmosphere within the enclosure. Since the motor is positioned toward the bottom of the cooler adjacent to the water level, the motor is subject to drips from pads or defective water conduits or to being submerged if knocked over during careless maintenance. As a result, the life of such motors is relatively short due to electrical and corrosion problems associated with the wet environment. The motors, therefore, frequently must be replaced during the life of an evaporative cooler at a substantial expense.

The water pump motor, even though relatively inexpensively constructed, is a significant portion of the cost of an evaporative cooler since such a cooler is a relatively simple device. Such a motor, being of fractional horse power due to the low head and limited flow of water required, is relatively expensive for the power developed. Such motors are frequently inefficient electrically due to their small size and economically oriented design.

The blower motors are more expensive than the water pump motors due to the higher power required by the blower. However, these motors are not as subject to damage from the wet environment since they are securely mounted toward the top of the enclosure away from the wettest conditions near the water level. The blower motors being of larger size are more efficient and can be of better construction than the water pump motors.

SUMMARY OF THE INVENTION

Accordingly, it is an object of the present invention to provide an improved water pump drive mechanism for an evaporative cooler.

Another object is to provide such a mechanism which has a long life when operated in the moist conditions within an evaporative cooler enclosure.

Another object is to provide such a mechanism which is relatively inexpensive.

Another object is to provide such a mechanism which is readily adaptable to conventional evaporative coolers both for new manufacture and for replacement purposes in existing, installed coolers.

Another object is to provide such a mechanism requiring relatively little energy for its operation.

Further objects and advantages are to provide improved elements and arrangements thereof in water pump drive mechanism for an evaporative cooler which is dependable, durable, and fully effective in accomplishing its intended purposes.

DESCRIPTION OF THE PREFERRED EMBODIMENT

Figure 1:
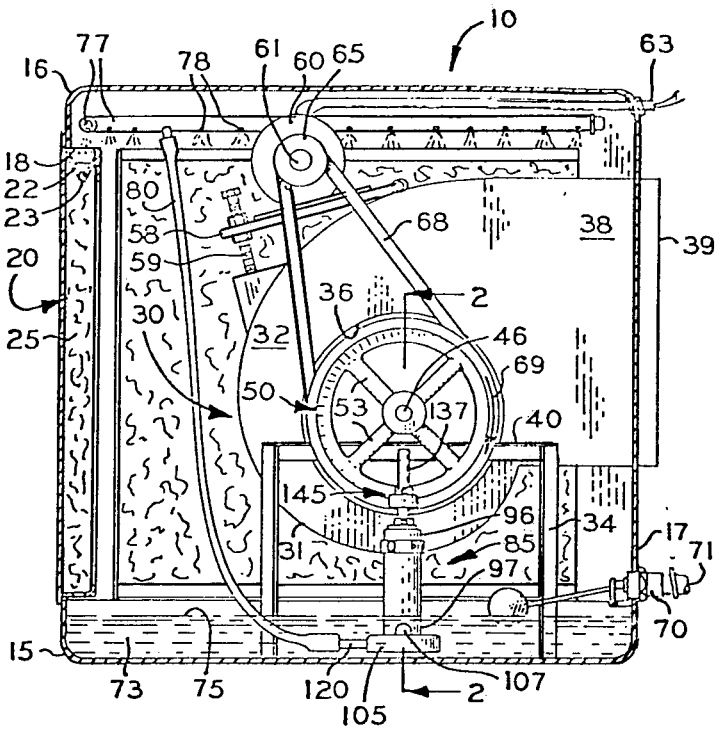
FIG. 1 is an elevation of an evaporative cooler, with a near side of an enclosure thereof removed to show the interior, provided with a water pump drive mechanism embodying the principles of the present invention.

Referring more particularly to the drawings, in FIG. 1 is shown a representative evaporative cooler which forms an operating environment for a water pump drive mechanism embodying the principles of the present invention.

The evaporative cooler includes a box-like, substantially cubical enclosure indicated generally by the numeral 10 and constructed largely of sheet material. The enclosure has a lower portion 15 which forms a rectangular water-tight basin and a cover 16. A solid wall 17 of sheet material forms one of the vertical sides of the enclosure. The remaining three vertical sides of the enclosure are substantially identical, each side having a large rectangular opening 18 centrally therethrough upwardly of the lower portion of the enclosure. Each of the openings 18 is provided with a pad 20 which substantially fills the opening. Each pad peripherally is enclosed in and supported by a rectangular frame of sheet material fitted within its respective opening. An upwardly open trough 22 forms an upper edge for each frame. The trough has slots 23 in the bottom thereof approximately equally spaced therealong. Each frame is detachably mounted on the enclosure 10 so that the entire pad can be removed for replacement or for access to the interior thereof. The frame is filled with a rectangular mass of coarse, loosely packed fibrous material 25, such as wood fiber, sometimes referred to as excelsior. The fibrous material is retained in the frame in a well-known manner by perforated sheet material 26 exteriorly of the enclosure and by screens, lacings, or the like 27 interiorly thereof.

A well-known squirrel cage blower, indicated generally by the numeral 30, is mounted centrally of the enclosure 10. The blower has a generally cylindrical housing 31 constructed of sheet material. The housing is disposed with its axis extending substantially horizontally and parallel to the solid wall 17 of the enclosure. The housing has opposite axial ends 32 which individually are spaced substantially inwardly from the pad 20 adjacent thereto. Each axial end of the housing has a circular opening 36 therethrough whose diameter is approximately one-half of the diameter of the housing. The openings are aligned about a substantially horizontal axis which is disposed in downward, eccentric relation to the axis of the housing. The housing is supported upwardly of the lower portion 15 of the enclosure by a plurality of legs 34 mounted on the axial ends of the housing and extending downwardly therefrom. A rectangular duct 38 extends substantially horizontally from the upper half of the housing through the solid wall 17 of the enclosure to an open discharge end 39 for air. A pair of bars 40 individually are mounted on the axial ends of the housing and extend horizontally across the inlet openings downwardly of the axis thereof. The bars individually support bearings 42 which are aligned with the axis of the air inlet openings. An axle 45 is rotationally received in the bearings. An end portion 46 of the axle extends oppositely of the housing from the bearing at one end thereof. An impeller 47 is mounted on the axle for rotation therewith between the axial ends of the housing 31.

A pulley 50 is mounted in rotational driving relation on the end portion 46 of the axle 45. The pulley is approximately the diameter of the inlet openings 36 and provided with a rim 52 connected by spokes 53 to a hub 54. The rim has a pair of opposite axially disposed surfaces 55. The surfaces are generally planar and are disposed in planes normal to the axle 45. The pulley is provided with a groove 56 extending circumferentially thereabout between the surfaces 55.

The blower 30 includes a mounting plate pivotally connected at one edge to the blower housing inwardly and oppositely thereof from the duct 38. The plate is connected to the housing for pivotal movement about an axis substantially parallel to the blower axle 45. A bolt 59 screw-threadably engages the plate at the edge thereof opposite to the pivotally connected edge. The bolt extends axially through the plate into engagement with the housing for a purpose subsequently to be described. An electric motor 60 is mounted on said plate. The motor has an output shaft 61 extending therefrom parallel to the blower axle 45 and approximately coextensive with the end portion 46 thereof. The motor is provided with an electric connection 63 extending through a suitable opening in the wall 17 of the enclosure 10 to a source of electric power, not shown. A driving pulley 64 is mounted on the output shaft for rotation therewith. Axially, the driving pulley is aligned with the blower pulley 50 on the blower axle. The driving pulley is provided with a groove corresponding to the groove 56 in the blower pulley. The pulley on the motor shaft is linked in rotational driving relation with the blower pulley by a belt 68 extending about the pulleys through their respective grooves. The motor is arranged to rotate in a direction so as to cause the blower pulley to rotate clockwise as shown in FIG. 1, in the direction indicated by the arrow 69. The tension of the belt can be adjusted in the well-known manner by rotation of the bolt 59 which results in pivoting of the plate toward and from the blower housing.

The evaporative cooler is provided with a float valve 70 of well-known construction. The valve is mounted on the solid wall 17 of the enclosure 10 in upwardly adjacent relation to the lower portion 15 thereof. The valve is connected by a conduit 71, which extends through a suitable opening in the wall 17, to a source of water under pressure, not shown. The valve is constructed and arranged to control flow of water from the source into the lower portion of the enclosure so as to maintain a quantity 73 of the water therein at a predetermined level 75. The water level is downwardly spaced from the blower housing 31. A plurality of distributor pipes 77 are mounted on the enclosure 10 and individually extend horizontally above the troughs 21 of the pads 20. Each pipe is provided with a plurality of openings downwardly therein and spaced therealong from which water can flow, as indicated by the numeral 78, into the adjacent trough. The distributor pipes are connected to a common flexible conduit 80 through which water is supplied to the pipes.

Figure 2:
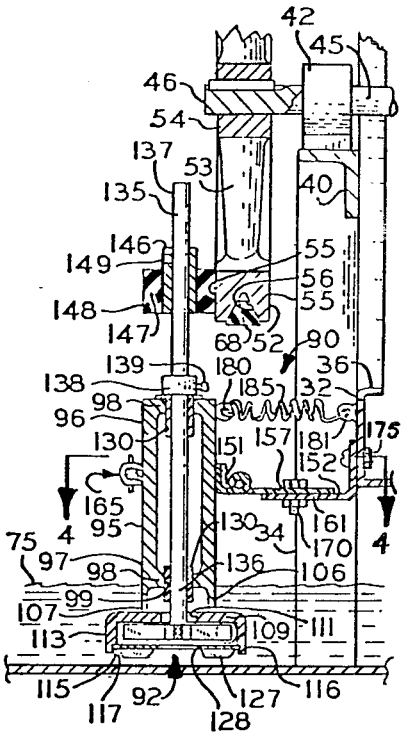
FIG. 2 is a fragmentary vertical section at a somewhat enlarged scale of the water pump drive mechanism taken on line 2—2 of FIG. 1 together with associated elements of the evaporative cooler.

The water pump drive mechanism of the present invention, preferably, is embodied in a unit 85, best shown in FIG. 2. The unit is mounted on the blower housing 31 at the axial end 32 thereof adjacent to the blower pulley 50. The unit has a water pump drive mechanism indicated generally by the numeral 90, embodying the principles of the present invention. This mechanism forms the upper portion of the unit. The unit has a centrifugal water pump 92 which forms the lower portion of the unit. This pump is similar to existing evaporative cooler water pumps.

The unit 85 has a substantially vertical shaft support 95 of cylindrical, tubular construction having an upper end 96 and a lower end 97. The lower end is disposed approximately at the water level 75. Each end of the support is closed by a transversely extending disk 98 having a circular opening 99 therethrough concentric with the axis of the support. The distance between said ends is somewhat less than the distance between the water level and the lower portion of the rim 52 of the blower pulley 50.

The tubular shaft support 95 is connected at the lower end 97 thereof to a pump casing 105. The casing has an upper inlet portion 106 which is a downward, axial extension of the tubular shaft support. The inlet portion extends from the lower end 97 of the support approximately one-third of the depth of the quantity 73 of water. Inlet portion has an opening 107 circumferentially therethrough for admission of water to the interior thereof. The pump casing has a transversely extending disk 109 concentric with and secured to the lower end of the inlet portion 106. The disk is substantially larger in diameter than the inlet portion and has a central circular opening 111 concentrically therethrough. A cylindrical tube 113 extends from the periphery of the disk oppositely of the inlet portion to an annular lower end 114. The axial length of the tube is approximately equal to the axial length of the inlet portion. The annular end of the tube is provided with a plurality of circumferentially spaced hooks 115 extending axially therefrom oppositely of the disk. Each hook has a first planar surface 116 parallel to and disposed toward said annular end. Each hook has a second planar surface 117 angularly related to the first surface and extending from the distal end of the hook centrally of the tube and toward the annular end thereof.

The shaft support 95 with the disks 98 thereof, preferably, is unitarily constructed of plastic material together with the previously described elements of the pump casing, the inlet portion 106, disk 109, tube 113, and hooks 115. A cylindrical conduit 120 extends substantially tangentially from the tube 113 to an open outlet end 121. The outlet end is adapted for fluid flow connection to the flexible conduit 80.

Figure 3:
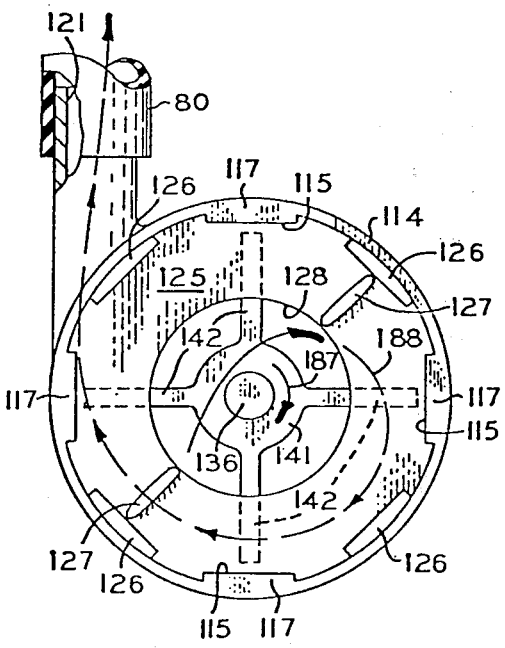
FIG. 3 is a bottom plan view of a pump utilized with the drive mechanism of FIG. 2 with a portion broken away for illustrative convenience.
Figure 4:
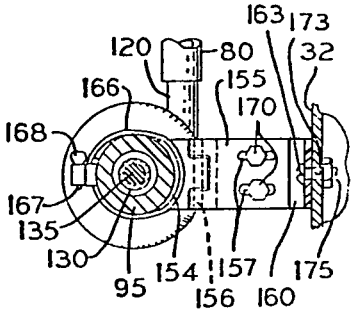
FIG. 4 is a fragmentary horizontal section at a further enlarged scale taken on line 3—3 of FIG. 2.

The pump casing 105 includes a detachable discoidal cover 125 best shown in FIGS. 2 and 3 dimensioned so as to fit internally of the hooks 115 in axial engagement with the annular end 114 of the tube 113. The circumference of the cover is provided with a plurality of notches 126 dimensioned and arranged so as to fit over the hooks when the cover is rotated to a predetermined position, as by manually engaging a pair of diametrically opposite ears 127 extending axially from the cover oppositely of the annular end 114. When so positioned, the cover can be secured to the balance of the casing by rotating the cover so that the opposite sides thereof are engaged, respectively, by the annular end and the surface 116 of the hooks. A circular water inlet opening 128 extends centrally through the cover.

The shaft support 95 is provided with a pair of bearing sleeves 130 individually secured in the openings 99 in the disks 98. The sleeves have individual central bores 131 which are aligned so as to be substantially concentrically related to the axis of the shaft support 95 and the pump casing 105. The sleeves, preferably, are constructed of neoprene or the like. A cylindrical pump drive shaft 135 is rotationally received in the sleeves. The shaft has a lower end 136 extending downwardly beyond the lower sleeve toward the detachable cover 125. The shaft has an upper end portion 137 extending beyond the upper sleeve adjacent to the surface 55 of the pulley 50 which is disposed axially oppositely of the housing. The upper end portion extends a distance such that the overall length of the shaft is approximately equal to the vertical distance from the lower portion of the rim 52 of the pulley to the bottom of the enclosure 10. The shaft is provided with a concentrically mounted collar 138 secured thereto by a setscrew 139 upwardly of the tubular support 95. The collar engages the upper end of the upper of the bearing sleeves 130 so that the weight of the shaft and elements mounted thereon is rotationally supported by said bearing sleeve.

The water pump 92 has a rotor 140 mounted on the lower end portion 136 of the drive shaft 135 which extends axially from the lower end of the sleeves 130 between the disk 109 and the cover 125. The rotor is concentric with the shaft and is secured to the lower end portion thereof so as rotationally to be driven therefrom. The rotor has a hub 141 circumscribing the shaft. A plurality of vanes 142 extend radially in equal angular relation from the hub toward the interior of the tube 113 of the pump casing 105.

A friction wheel 145 is concentrically mounted on the portion of the drive shaft 135 extending from the upper of the sleeves 130. The wheel has a sleeve-like hub 146 interiorly slidably fitted to the drive shaft for movement axially therealong. The hub is circumscribed by an annulus 147 having a cylindrical periphery 148 and constructed of a resiliently flexible friction material such as rubber. The annulus is secured to the hub for rotation therewith. Axially, the annulus is somewhat longer than the width of the axially disposed surface 55 of the rim 52 of the blower pulley 50 measured radially of the pulley. Axially, the hub is somewhat longer than the annulus, and a portion of the hub extends axially therefrom. A setscrew 147 screw-threadably engages the hub at right angles to the axis thereof. The setscrew, in a well-known manner, releasably secures the wheel at any predetermined position along the drive shaft for rotational movement therewith.

The unit 85, which includes the water pump drive mechanism 90, is mounted, as previously mentioned, on the axial end 32 of the housing 31 adjacent to the blower pulley 50. The unit is mounted by a bracket assembly indicated generally by the numeral 150. The bracket assembly includes a hinged L-shaped member 151 adapted to engage the tubular bearing support 95 and a rigid L-shaped member 152 adapted to engage said axial end of the blower housing. The hinged member includes a vertical arcuate leaf 154 and a first horizontal, slotted leaf 155 of sheet material. The leaves are interconnected by a hinge 156 providing pivotal movement between the leaves about a horizontal axis. The arcuate leaf extends upwardly from the hinge and has a concave side fitted to the exterior of the cylindrical shaft support 95. The slotted leaf is provided with an elongated slot 157 extending substantially at a right angle to the axis of the hinge. The rigid L-shaped member includes a second horizontal, slotted leaf 160, substantially identical to the slotted leaf 155, having a slot 161 therethrough. The rigid member, preferably, is unitarily constructed of sheet material. A vertical leaf 162 extends upwardly from the second slotted leaf oppositely of the hinge 156. A plurality of bores 163 extend horizontally through the vertical leaf.

The arcuate leaf 154 is positioned with its concave side engaging the tubular shaft support 95 so that the axis of the hinge 156 is positioned downwardly of the upper end 96 of the support. The arcuate leaf is secured to the shaft support by a well-known type of hose clamp indicated generally by the numeral 165. The hose clamp has an overlapping metal band 166 which circumscribes the shaft support. The arcuate leaf is inserted between the band and the support. The band has a plurality of slots, not shown, therealong. The clamp has a bolt 167 mounted at one end of the band which screw-threadably engages the slots in succession as the bolt is rotated by a key 168 fixed to the bolt. Loosening the clamp, by rotation of the bolt so as to move the band away from the bolt, permits rotational and vertically slidable movement of the shaft support relative to the arcuate leaf. Tightening the clamp by opposite rotation of the bolt releasably clamps the shaft support to the bracket assembly 150 at any position of such rotational and vertical movement.

The slotted leaves 155 and 160 are engaged in parallel facing relation with a first bolt assembly 170 extending through the slots 157 and 161, respectively, thereof. The vertical leaf 162 is engaged in parallel facing relation with the planar axial end 32 of the blower housing 31 disposed toward the pulley 50. This axial end is provided with a plurality of bores 173 aligned with the bores 163 in the vertical leaf 162 of the rigid L-shaped member 152. A plurality of second bolt assemblies 175 individually extend through the respective aligned bores 163 and 173 and secure the bracket assembly to the blower housing. The position of the shaft support 95 relative to the housing is horizontally adjustable by the slidable movement of the first slotted leaf 155 horizontally in relation to the second slotted leaf 166. The leaves may be releasably clamped at any position along such movement by tightening the first bolt assembly 170.

As best shown in FIG. 2, the unit 85 is mounted by the bracket assembly 150 on the blower housing 31 in such a position and attitude that the water pump 92 is below the water level 75 and the drive shaft 135 extends therefrom substantially vertically, axially spaced from the pulley oppositely of the housing, and at substantially a right angle to the blower axle 45. The depth of the pump in relation to the water level can be adjusted by vertical slidable movement of the shaft support in relation to the arcuate leaf 154 and to the housing to which said leaf is secured. The angular position of the discharge conduit 120 about the shaft can be adjusted by rotational movement between the shaft support and the arcuate leaf. The pump unit can be releasably clamped at any desired position of such movements by the hose clamp 165. The position of the unit 85 along the blower axle and the spacing of the shaft axially of the pulley 50 can be adjusted by slidable horizontal movement between the first and second slotted leaves, 155 and 160 respectively, which provide adjustable movement of the shaft toward and from the blower housing. The shaft, preferably, is so spaced in relation to the pulley that the periphery of the friction wheel 145 engages the axially disposed surface 55 of the pulley when the shaft is at the point in the pivotal movement provided by the hinge 156 at which the shaft is substantially vertical. This position of the shaft is maintained by releasably clamping the slotted leaves together by tightening the first bolt assembly 170. The friction wheel is slid along the shaft to a position in which the wheel peripherally engages the surface 55 of the pulley when the shaft is disposed as previously described. The wheel is releasably secured in such position by tightening the setscrew 149.

The upper end 96 of the shaft support 95 is provided with a first eye 180 extending toward the adjacent axial end 32 of the blower housing. Said axial end is provided with a second eye 181 opposite the first eye and extending theretoward. A tension spring 185 interconnects the first and second eyes so as resiliently to urge the upper end of the shaft support toward the blower housing by pivotal movement of the hinge 156. The portion of the drive shaft 135 upwardly of the hinge is carried with the shaft support toward the pulley 50 so that the periphery 149 of the wheel 145 is urged into frictional engagement with the adjacent axially disposed surface 55 of the pulley. The wheel is rotationally driven by such frictional engagement. The shaft is rotationally driven from the wheel in a direction, clockwise as shown in FIG. 3 as indicated by the arrow 187. The rotor 140 of the pump 92 rotates with the shaft so that the pump rotationally is driven from the pulley 50 mounted on the axle 45 of the blower 30. As a result, water is drawn through the openings 111 and 128 and discharged under pressure from the outlet end 121 of the pump through conduit 120 into the flexible conduit 80 as indicated by the arrows 188. The diameter of the friction wheel is such that the rotor is driven at the proper rotational speed to provide a satisfactory supply of water to the pads 20. Such diameter is, of course, proportioned to the diameter of the pulleys 50 and 65 and the rotational speed of the motor 60.

OPERATION

The operation of the described embodiment of the present invention is believed to be clearly apparent and is briefly summarized at this point together with the general operation of the evaporative cooler.

When initially manufactured, an evaporative cooler can have installed therein a unit 85 which includes a water pump drive mechanism 90 embodying the present invention and a water pump 92. Such an installation provides relatively lower initial cost together with greater reliability in operation. However, the unit 85 is particularly adapted for replacement in an existing evaporative cooler of a conventional water pump and motor unit of the type previously described. The need for replacement of such a conventional unit is, as previously described, relatively frequent due to the deterioration of the motor thereof under the ambient conditions to which the motor is subjected.

The unit 85 of the present invention is well suited for provision in a "do-it-yourself" kit. To mount the unit it is only necessary to form, as by drilling, the bores 173 in the blower housing 31 and to secure the unit thereto with the second bolt assemblies 175. Said bores need only be located in the general area of the housing where said bores are depicted in FIG. 2 because of the positional adjustments provided in the bracket assembly 150. This assembly provides, as previously described, slidable adjusting movement of the tubular shaft support 95 horizontally and vertically relative to the blower housing 31. Provision is also made for adjustment of the position of the friction wheel 145 along the shaft 135. As a result, a single unit 85 conveniently is adapted for installation on existing evaporative coolers having a wide range of sizes and proportions. Once the position of such a unit is properly adjusted relative to the housing, the unit can be clamped in such position as previously described. Installation of the unit is then completed by connection of the flexible conduit 80 to the discharge outlet 120 of the pump 92. Such connection in an existing cooler is facilitated by the releasably clamped rotational movement provided for the tubular shaft support 95 relative to the arcuate leaf 154. This movement allows the discharge outlet to be directed toward the existing path of the flexible conduit.

An evaporative cooler provided with a unit 85 embodying the present invention is conventionally arranged with the discharge end 39 of the duct 38 directed into a location which is to be cooled, with the electrical connection 63 of the motor 60 connected to a suitable source of electrical energy, and with the conduit 71 of the float valve 70 connected to a source of water. The float valve maintains the predetermined level 75 of water in the lower portion 15 of the enclosure 11. The motor rotationally drives the impeller 47 of the blower through the belt pulley 75, belt 68, pulley 50, and axle 45. As a result, air is drawn, as previously described, into the enclosure through the wetted fibrous material 25 of the pads, through the inlet openings 26, through the impeller, and discharged through the housing 31 and duct 38 thereof. Heat from the air passing through the wetted fibrous material is removed to evaporate a portion of water wetting the material so that the temperature of the air is reduced to a comfortable level.

As the pulley 50 rotates, it rotationally drives the wheel 145 through frictional engagement between the periphery 149 of the annulus 147 with the axially disposed, annular surface 55 which is engaged therewith. The pressure of said engagement is maintained approximately constant despite slight misalignment of the axes of the pump drive shaft 135 and the blower axle 45, wear of the engaging surfaces, and irregularities of the blower pulley. The tension spring 185 constantly urges the wheel into engagement with the pulley so that this constant pressure is maintained at a level sufficient to prevent undue slippage between the pulley and the wheel without additional, power-wasting pressure.

Rotational movement imparted to the wheel 145 by the blower pulley 50 is, in turn, imparted to the drive shaft 135 and, from there, to the rotor 140 of the pump 92. Rotation of the rotor causes water to be drawn, in the well-known manner of a centrifugal pump, through the openings 111 and 128, which are below the water level 75. The water is then discharged, as is usual in evaporative coolers, through the discharge conduit 120 of the pump casing 105 and the flexible conduit 80 into the distributor pipes 77. Water flows from these pipes, as indicated by the numeral 78, into the troughs 22 from which the water drips through the slots 23 so as to wet the fibrous material 25.

The cover 125 of the pump casing 105 can be removed by rotation of the cover relative thereto to a position such that the notches 126 of the cover are aligned with the hooks 115 of the casing. The cover can then be axially withdrawn from the casing for access, as for cleaning the interior thereof. The cover can be reinstalled, as previously described, by reversing these procedures. Manual rotation of the cover is facilitated by the ears 127 which may be grasped by the fingers.

As can be seen from the foregoing description, the unit 85 incorporating the water pump drive mechanism 90 of the present invention can be simply constructed of inexpensive, non-corrodible material so that the unit forms a low cost, long-lived device adapted for use with conventional evaporative coolers either as original equipment or as a convenient replacement in existing coolers. Since the unit rotationally drives the water pump 92 from the blower pulley 50 which is driven, in turn, by the electric motor 60, the expense of providing more than one motor in each cooler is avoided. Once installed the unit requires no attention, except for occasional cleaning which is facilitated by the detachable cover, since the proper frictional engagement of the pulley 50 and wheel 45 are maintained by the tension spring 185.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. In combination with an evaporative cooler having a blower, a pulley rotationally driving the blower, and a rotationally driven water pump, a drive mechanism for the pump comprising:

a drive shaft connected in rotational driving relation to the pump and extending therefrom adjacent to the pulley;

a wheel mounted on the shaft in rotational driving relation thereto and peripherally engaged in rotationally driven relation by the pulley; and means for adjustment of the position of said pump and said wheel with respect to said pulley, comprising means for fixing said adjustment at a selected position, said means for adjustment permitting adjustment of the wheel with respect to the pulley in two substantially orthogonal directions.

2. The combination of claim 1 in which the periphery of the wheel is frictionally engaged with the pulley.

3. The combination of claim 2 in which the mechanism includes means mounting the shaft on the cooler for movement of the wheel toward and from the pulley, and means for resiliently urging the wheel toward the pulley into said engagement.

4. A water pump drive mechanism for use with an evaporative cooler, the cooler having a lower portion containing water at a predetermined level; a blower housing upwardly spaced from the water; a blower axle rotationally mounted on the housing and axially extending substantially horizontally therefrom; a pulley mounted on the axle in rotational driving relation thereto, the pulley having toward the periphery thereof an axially disposed surface; and a rotationally driven water pump downwardly disposed from the pulley, the pump drive mechanism comprising:

a drive shaft extending upwardly from the pump in axially spaced relation to the pulley from said surface, having a lower end portion engaged in rotational driving relation to the pump and an upper end portion adjacent to said surface;

a shaft support extending along the shaft having means for rotationally mounting the shaft;

a friction wheel mounted on the upper end portion of the shaft, for rotational movement therewith, and the wheel peripherally engaging said surface in frictionally driven relation thereto whereby the shaft rotationally is driven from the pulley together with the blower axle; and means for adjusting the position of said shaft support with respect to said pulley, wherein the axes of said friction wheel and said pulley are substantially orthogonal.

5. The mechanism of claim 4 in which the pump has a rotor, and the rotor is secured to the lower end portions of the shaft in rotationally driven relation therefrom.

6. The mechanism of claim 4 in which the pump has a casing and in which the shaft support is tubular, circumscribes the shaft, and the casing is fixedly mounted on said support.

7. The mechanism of claim 4 in which said means for adjusting the position of said shaft support comprises means for mounting the shaft support for movement in two substantially orthogonal directions, and means for clamping said support at selected positions.

8. The mechanism of claim 4 including:

means for mounting the shaft support for substantially horizontally slidable movement toward and from the housing and for substantially vertically slidable movement relative thereto, and means for releasably clamping the support at selected positions along said horizontally slidable movement and along said vertically slidable movement.

9. The mechanism of claim 4 in which the shaft support is pivotally connected to the cooler for movement of the wheel toward and from said surface of the pulley and the mechanism includes means for urging the wheel into engagement with the said surface.

10. The mechanism of claim 9 in which the pump has a casing and a rotor therein and in which:

the shaft support has a lower end fixed to the casing;

the rotor is secured to the lower end portion of the shaft for rotation therewith;

the shaft support has an upper end and is mounted on the housing for pivotal movement about a substantially horizontal axis disposed downwardly of said upper end, and the means for urging the wheel into engagement with said surface of the pulley includes a resilient member tensionally connecting the housing and the upper end portion of the shaft support.

11. In an evaporative cooler having a blower driven by a pulley having a concentric, axially disposed, flat annular face disposed in a substantially vertical plane, the improvement comprising:

a pump having a rotatable drive shaft;

means mounting the pump with the drive shaft upwardly extended adjacent to the pulley in a plane perpendicular to the face for pivotal movement about a pivot point toward and from the face in said plane;

a friction drive wheel mounted on the drive shaft for slidable adjustment therealong and for rotational engagement with the face when the pump is pivoted to move the shaft toward the face;

resilient means urging the drive wheel in pivotal movement toward the face; and, means for providing substantially horizontal adjustment of said pivot point with respect to said face.

* * * * *